United States Patent [19]

Erdmann

[11] Patent Number: 4,903,370

[45] Date of Patent: Feb. 27, 1990

[54] CURTAIN TIEBACK WITH A HOLDER FOR INTERCHANGEABLE DECORATIVE FRONTS

[76] Inventor: Suzanne L. Erdmann, 10832 S. 112th St., Franklin, Wis. 53132

[21] Appl. No.: 245,913

[22] Filed: Sep. 19, 1988

[51] Int. Cl.[4] ..... E05D 15/00; A47H 1/00

[52] U.S. Cl. ..... 16/87.2; 160/349.2; 24/303

[58] Field of Search ..... 16/87.2, 121; 24/303; 292/251.5; 160/349.2; D6/578; D8/368

[56] References Cited

U.S. PATENT DOCUMENTS

| | | | |
|---|---|---|---|
| 2,224,772 | 12/1940 | Ross | 16/121 |
| 2,992,466 | 7/1961 | Gallagher | 24/303 |
| 3,136,547 | 6/1964 | Schaper | 24/303 |
| 3,509,734 | 5/1970 | Lederer | 24/303 |
| 4,480,361 | 11/1984 | Morita | 24/303 |
| 4,700,436 | 10/1987 | Morita | 24/303 |

*Primary Examiner*—Nicholas P. Godici
*Assistant Examiner*—Carmine Cuda

[57] ABSTRACT

A curtain or drapery holding device having a removable magnetic front piece. The front piece taking various decorative forms.

2 Claims, 1 Drawing Sheet

CURTAIN TIEBACK WITH A HOLDER FOR INTERCHANGEABLE DECORATIVE FRONTS

BACKGROUND OF THE INVENTION

This invention relates to an improvement in curtain or drapery holders for use in the home or in business.

In the past, curtains have been pulled to the side or draped. To hold them in this position, tacks in one form or another have been used. It is an object of this invention to add another dimension to these tacks in the form of decorative front pieces.

Since the means for holding curtains or draperies is also decorative, it is an additional object of this invention to provide curtain or drapery tacks which are in themselves decorative.

Since it is desirable to be able to change from one motif to another with minimum effort, it is another object of this invention to provide front pieces which may be changed rapidly, and which may be used for other purposes.

DESCRIQTION OF THE DRAWINGS

DESCRIPTION OF THE PREFERRED EMBODIMENT

Figure 1:
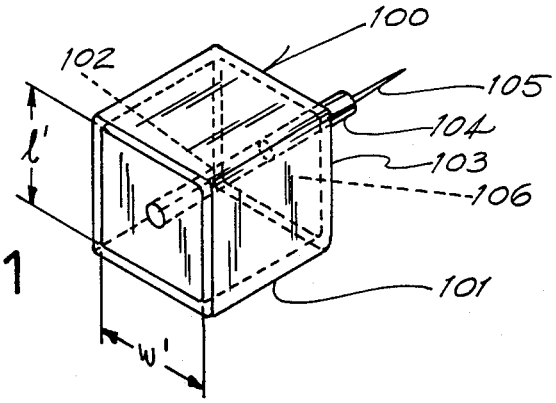
FIG. 1 is a view of a first member of the device.

With reference to the figures, member 100, which may be made of plastic or any other suitable material, has a cup-shaped portion 101 and at least one rod shaped portion 104 which is attached to base 103 of cup 101 on a first end. Although, the invention is operative without it, in the preferred embodiment, guide pin 102 may be attached to the inner portion of cup 101. If guide pin 102 is used, it may be located at the center of the inside of cup 101 or may be located in some offset position. Although the periphery of cup 101 is approximately rectangular in shape in the specific embodiment shown in FIG. 1, the periphery may assume any shape which is convenient. The periphery could, for example, be circular.

Needle 105, which is affixed to the second end of rod 104, provides the means for attaching member 100 to a wall, window frame or other relatively flat surface. Many other attachment means, as for example, glue, could be used.

The diameter of rod 104, although not critical, should be sufficiently greater than the diameter of needle 105 to provide a shoulder capable of holding the curtain or drapery material against a vertical surface.

Plate 106, which may be made of steel or other material capable of being attracted by a magnet, (hereinafter called magnetic material) is rectangular in shape and slightly smaller than the bottom surface of interior of cup 101 so that it will fit within cup 101 and may be attached to the inside of base 103. Hole 107 in plate 106 is formed so that it is in alignment with post 102 when plate 106 is inserted in cup 101. Since the shape of cup 101 may vary, the shape of plate 106 must vary in conformity therewith.

Figure 2:
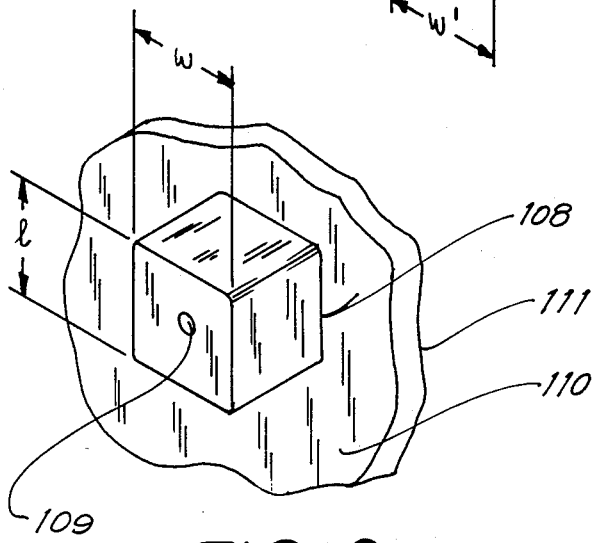
FIG. 2 is a view of a second member of the device.

Rectangular prism 108, shown in FIG. 2, is a magnet, the length "l" of which is slightly smaller than the length (l') of the interior of cup 101 and the width "w" of which is slightly smaller than the width (w') of the interior of cup 101 so that the bottom of magnet 108 may be slidably inserted in cup 101. Hole 109, in magnet 108, is slightly larger in diameter than, and formed so that it is in alignment with guide pin 102 when magnet 108 is inserted in cup 101. If the embodiment of this invention does not include guide pin 102, hole 109 need not be formed in magnet 108.

The height of magnet 108 is slightly greater than the depth of cup 106 so that magnet 108 will protrude slightly from cup 101 when inserted therein.

Front piece 111, which is attached to the top of magnet 108 by any suitable means, acts as a knob by which magnet 108 may be extracted from cup 101 and also as a decorative object. Assembly 110, which comprises front piece 111 and magnet 108 may be changed as desired without disturbing member 100 so that the user may, for example, use a frontpiece in the shape of a Santa Claus at Christmastime and a frontpiece in the shape of a heart on Valentines Day.

It is within the contemplation of this invention that the placement of magnet 108 and plate 106 may be interchanged. That is to say that a magnet may be attached to the cup and a plate attached to the frontpiece.

Figure 3:
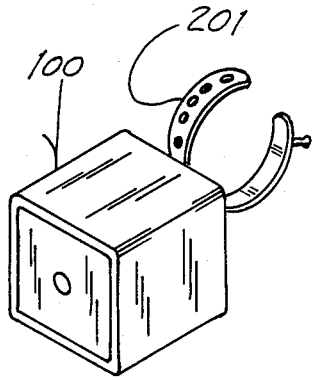
FIG. 3 shows the first member with a belt attaching means.
Figure 4:
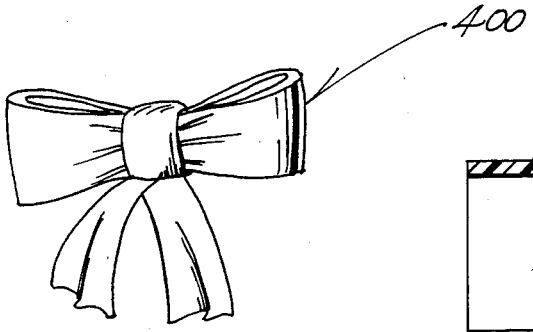
FIG. 4 shows one form of the device attached to a bow tie back.

Means, other than a tack may be used to affix the device to a wall or other surface. FIG. 3 shows an embodiment of this invention wherein rod 104 and pin 105 have been replaced by belt 201. Belt 201 is attached to the bottom of cup 101 by any convenient means, and in turn, may be used to attach the device to a bow of the type that is often used to hold back curtains and draperies. A bow of the type described, with the device in place, is shown in FIG. 4. Any means, such as velcro, may be used to hold the belt closed.

Figure 5:
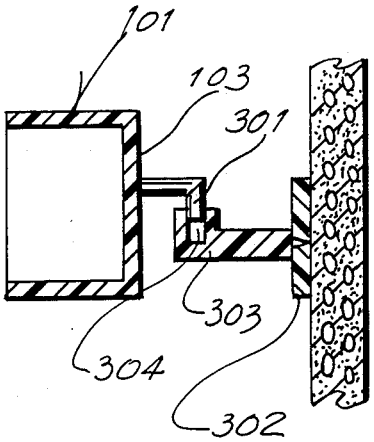
FIG. 5 shows alternate attachment means.

FIG. 5 shows another embodiment of this invention wherein rod 104 and needle 105 have been replaced by clip 301, which is attached by any convenient means to base 103 of cup 101, member 302, which may be of any convenient shape, and which may be attached to a relatively smooth surface with glue or any other convenient means, and elbow member 303 which may be pinned to member 302. Elbow member 303 has hole 304 formed therein so that clip 301 may be inserted in said hole 304 thereby rotatably connecting clip 301 to elbow member 303.

What is claimed is:

1. A curtain tieback comprising:

a. a hollow cup-shaped member;

b. a clip, formed from a rod which has been bent to form a right angle and attached to the exterior of the bottom of the cup-shaped member on one end;

c. an elbow member, having a hole formed therein, which is in turn attached to a base member by suitable means, the clip being rotatably attachable to the elbow member through the hole;

d. a plate, made of magnetic material, which is attached to the bottom of the cup-shaped member; and e. a second member comprising a magnet and a front piece which is attached to one end of the magnet, said magnet being slightly smaller in size and similar in shape to the interior of the cup-shaped member so that the magnet may be slidably inserted in said cup-shaped member, the front piece being of decorative shape and providing the means for grasping the second member for removal from attachment to the cup-shaped member.

2. A curtain tieback comprising:

a. a hollow cup-shaped member;

b. a clip, formed from a rod which has been bent to form a right angle and attached to the exterior of the bottom of the cup-shaped member on one end;

c. an elbow member, having a hole formed therein, which is in turn attached to a base member by suitable means, the clip being rotatably attachable to the elbow member through the hole;

d. a magnet which is attached to the inside of the bottom of the cup-shaped member; and e. a second member comprising a front piece and a block of magnetic material attached to said front piece, the block being slightly smaller in size and similar in shape to the interior of the cup-shaped member so that the block of magnetic material may be slidably inserted in said cup-shaped member, the front piece being decorative in shape and providing the means for grasping the second member for removal from attachment to the cup-shaped member.

* * * * *